US005700327A

United States Patent [19]

Babacz et al.

[11] Patent Number: 5,700,327

[45] Date of Patent: Dec. 23, 1997

[54] METHOD FOR CLEANING HOLLOW ARTICLES WITH PLASMA

[75] Inventors: Robert J. Babacz, Hellertown, Pa.; Kadthala R. Narendrnath, Newfield, N.J.; Kevin Frake, Bristol; Melissa A. Baylog, Easton, both of Pa.

[73] Assignee: Polar Materials, Incorporated, Pennsville, N.J.; by said M. Baylog, R. Babacz and K. Narendrnath

[21] Appl. No.: 402,091

[22] Filed: Mar. 10, 1995

(Under 37 CFR 1.47)

[51] Int. Cl.[6] ..... B08B 7/00

[52] U.S. Cl. ..... 134/1.1; 219/121.36; 219/121.41

[58] Field of Search ..... 134/1.1; 422/22, 422/23; 219/121.36, 121.4, 121.41, 121.43

[56] References Cited

U.S. PATENT DOCUMENTS

| | | | |
|---|---|---|---|
| 3,383,163 | 5/1968 | Menashi | 422/23 |
| 3,600,126 | 8/1971 | Hellund | 422/23 |
| 3,701,628 | 10/1972 | Ashman et al. | 422/23 |
| 3,806,365 | 4/1974 | Jacob | 134/1 |
| 4,207,286 | 6/1980 | Boucher | 422/22 X |
| 4,529,474 | 7/1985 | Fujiyama et al. | 156/643 |
| 4,717,806 | 1/1988 | Battey et al. | 219/121.41 |
| 4,797,178 | 1/1989 | Bui et al. | 156/643 |
| 4,816,113 | 3/1989 | Yamazaki | 134/1.1 |
| 4,877,757 | 10/1989 | York et al. | 427/235 |
| 5,064,614 | 11/1991 | Reiss et al. | 422/22 |
| 5,163,458 | 11/1992 | Monroe | 134/1 |
| 5,171,525 | 12/1992 | Jacob | 422/23 |
| 5,174,856 | 12/1992 | Hwang et al. | 156/643 |
| 5,176,791 | 1/1993 | Itoh et al. | 156/643 |
| 5,178,829 | 1/1993 | Moulton et al. | 422/23 |
| 5,186,893 | 2/1993 | Moulton et al. | 422/23 |
| 5,200,158 | 4/1993 | Jacob | 422/292 |
| 5,236,512 | 8/1993 | Rogers et al. | 134/1 |
| 5,244,629 | 9/1993 | Caputo et al. | 422/22 |
| 5,521,351 | 5/1996 | Mahoney | 219/121.43 |

OTHER PUBLICATIONS

"Specifications and Guidance for Contaminant–Free Sample Containers," OSWER Directive #9240.0–05A, Dec. 1992, pp. 1–26, Office of Emergency and Remedial Response, Office of Solid Waste and Emergency Response, U.S. Environment Protection Agency, Washington, D.C.

*Primary Examiner*—Arlen Soderquist
*Assistant Examiner*—Saeed Chaudhry
*Attorney, Agent, or Firm*—Lerner, David, Littenberg, Krumholz & Mentlik

[57] ABSTRACT

A method of cleaning a hollow article comprises a step of introducing an oxidizing working gas into at least an interior portion of the hollow article, while a sub-atmospheric pressure is being maintained therein. Then, an electric field is applied, so as to convert the oxidizing working gas within at least the interior portion of the article into a low temperature plasma. This leads to oxidizing substances situated at least within the interior portion of the hollow article.

24 Claims, 4 Drawing Sheets

METHOD FOR CLEANING HOLLOW ARTICLES WITH PLASMA

FIELD OF THE INVENTION

This invention relates to cleaning of surfaces, and more particularly, to a method and apparatus for cleaning with plasma of hollow articles such as containers.

BACKGROUND OF THE INVENTION

Containers are used for dispensing, storing of consumer products, pharmaceuticals and the like as well as for carrying samples in laboratory testing. One of the most challenging tasks in using the containers in mass production has been to sufficiently clean their interior surfaces, so that troublesome contaminants are removed or their effects are minimized to an acceptable degree. A large scale analytical testing operation require simultaneous cleaning to a very high degree of a large quantity of containers. In particular, environmental tests require many containers free of organic contaminants on their interior surfaces. Regulating authorities such as the United States Environmental Protection Agency ("EPA") and other organizations impose strict standards for cleanliness of those containers.

Among contaminants which are typically removed during the cleaning procedure, organic compounds such as volatiles, semivolatiles and pesticides are particularly troublesome. Removal of organic greases and oils is a substantially more difficult task than elimination of water soluble contaminants. This makes cleaning of the containers in general and interior portions thereof in particular difficult, time consuming and expensive.

In order to more thoroughly clean a container, it is conventional to use various types of chemical cleaners. Such cleaning procedures involving use of chemical agents such as solvents, acids, and caustics or using mechanical scrubbing, which are known for their drawbacks. Many chemical solvents and cleaners are drawbacks. Many chemical solvents and cleaners are corrosive, toxic and/or flammable. They are also known to be environmentally harmful. In accordance with government regulations, such hazardous materials should be disposed following applicable hazardous waste regulations. Compliance with such requirements often increase the cost of the cleaning process to a substantial degree.

State and federal legislation severely restrict the use of hazardous substances in the working environment. Such regulations also restrict the use of any system or method which produces toxic residues or exhaust products. Further, cleaning chemicals themselves can contaminate the containers. The result is a major challenge to a container cleaning operation utilizing chemical solvents and cleaners to remove oily contamination from the container surfaces.

Moreover, many cleaning processes are unsuitable for cleaning the caps and seals used with analytical containers.

Thus, there has been a considerable need for improved method for cleaning hollow articles, and specifically the interior of containers in general and those used in analytical testing in particular. There have been corresponding needs for an improved apparatus for performing of such methods.

SUMMARY OF THE INVENTION

One aspect of the present invention provides a method for cleaning of at least one hollow article with plasma. A method according to this aspect of the invention preferably includes the step of introducing an oxidizing, working gas within at least the interior portion of the hollow article, while maintaining sub-atmospheric pressure therein. An electric field is then applied, so as to convert the working gas within at least the interior portion into a low temperature plasma, so that the plasma oxidizes substances situated method of the invention, the electric field is applied from the exterior of the hollow article.

Typically, the oxidizing, working gas is an oxygen containing gas, preferably selected from the group consisting of $O_2$, $N_2O$, etc.

In the preferred method, an electric field is a radio frequency electric field such as a field having frequency of 13.56 MHz. The working gas is maintained within the interior portion at a pressure between 0.1 and 0.5 Torr, whereas the temperature of the plasma is below 40° C.

In another aspect of the method according to the present invention, the electric field pulses causing pressure fluctuation within at least the interior portion of the hollow article. This pulsing action facilitates removal of products of oxidation from the interior portion and supply of working gas to the interior portion.

A further aspect of the present invention includes an apparatus for cleaning of at least one container made of dielectric material. The apparatus according to this aspect of the invention includes means for introducing an oxidizing, working gas into and maintaining a sub-atmospheric pressure within at least the interior portion of the container, and means for applying an electric field, so as to convert the oxidizing, working gas within at least the interior portion into a low temperature plasma. Preferably, the means for applying electric field comprises power supply means for producing an electrical potential and electrode means for applying the potential to the container. The electrode means preferably includes two electrodes, so that when the power supply means is connected to the electrodes, a discharge between these two electrodes has been generated. In this embodiment of the invention, the electric field is preferably a radio frequency electric field, such as a field having frequency of 13.56 MHz.

Still further aspect of the invention includes an apparatus for cleaning of at least one container. This apparatus consists of a working chamber, means for transporting and retaining at least one container within the working chamber, means for introducing an oxidizing, working gas into and maintaining a sub-atmospheric pressure within the working chamber, and the means for applying an electric field, so as to convert the oxidizing working gas within the working chamber into a low temperature plasma. Preferably, the means for applying electric field comprises power supply means for producing an electrical potential and electrode means for applying the electrical potential to the container. The electrode means typically comprises first and second electrodes. Preferably, the means for transporting and retaining the container includes a support platform moving in and out of the working chamber. The power supply means is arranged in such a manner that the working chamber serves as the first electrode and the support platform serves as the second electrode. Pulsing means can be provided for pulsing the electric potential within the working chamber and within the interior portion of the container to generate a pressure fluctuation within the interior portion of the container.

BRIEF DESCRIPTION OF THE DRAWINGS

Other advantages and features of the invention are described with reference to exemplary embodiments, which are intended to explain and not to limit the invention, and are illustrated in the drawings in which.

DETAILED DESCRIPTION OF THE PREFERRED EMBODIMENTS

Although specific embodiments of the invention will now be described with reference to the drawings, it should be understood that the embodiments shown are by way of example only and merely illustrative of but few of many possible specific embodiments which represent application of the principles of the invention. Various changes and modifications obvious to one skilled in the art to which the invention pertains are deemed to be within this spirit, scope and contemplation of the invention as further defined in the appended claims.

Figure 1:
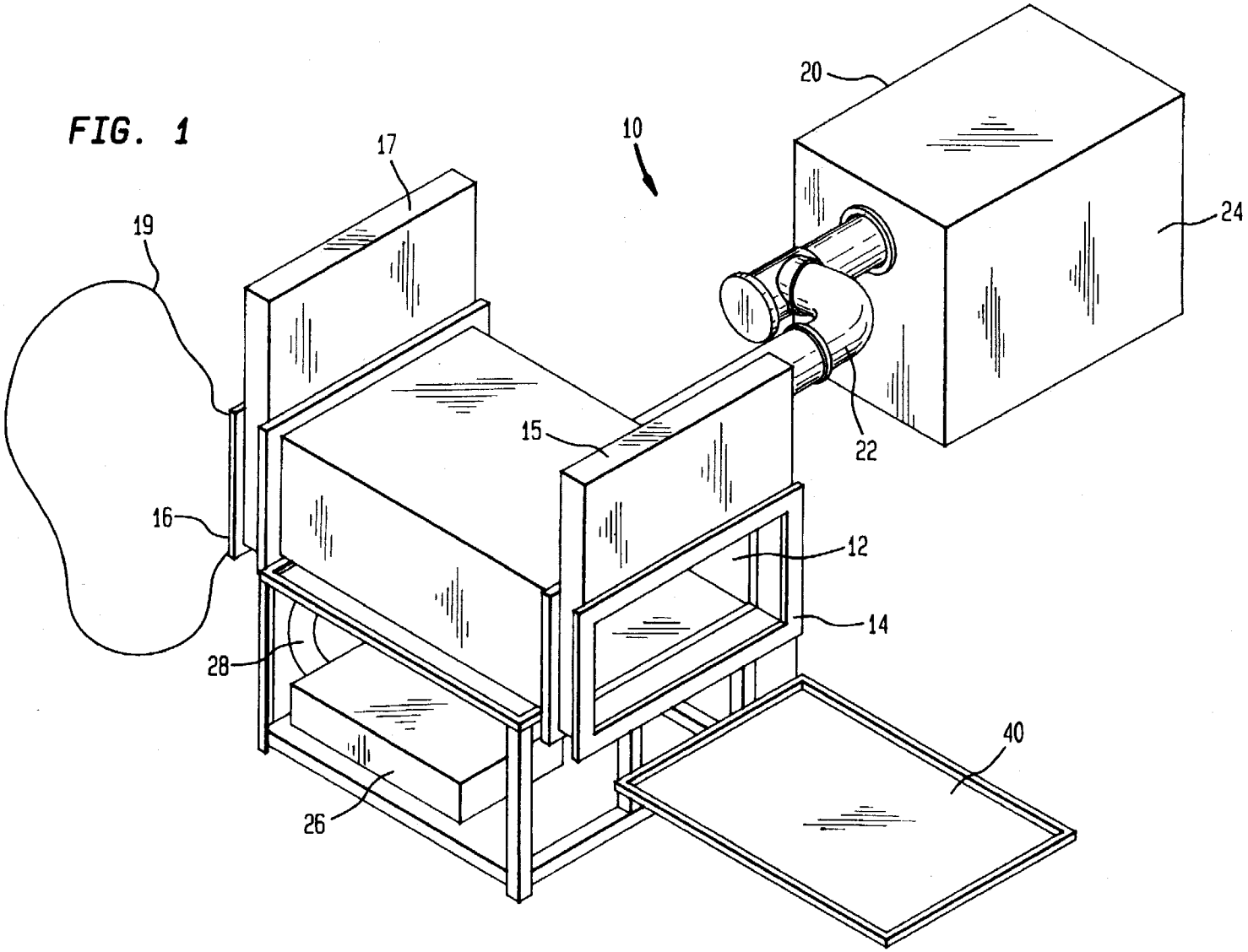
FIG. 1 shows a semi-perspective view of the apparatus according to one embodiment of the present invention.

A method of cleaning hollow articles or containers according to one embodiment of the present invention utilizes a plasma reactor 10 depicted in FIG. 1. A working chamber 12 is situated between a front end 14 and a rear end 16 of the reactor. A front gate 15 and a rear gate 17 are provided to isolate an interior of the working chamber from ambient environment during its operation. Means or a gas unit 20 is adopted for storing and introducing a working gas into the working chamber 12. The unit 20 is provided with a gas manifold 22 connecting a source of working gas 24 with the interior of the working chamber. The gas manifold contains a plurality of entry ports (not shown) communicating with the interior of the chamber 12. The interior of the working chamber is also connected to a sub-atmospheric pressure pump 26 through an exhaust conduit 28 having a plurality of exhaust ports open to the working chamber (not shown). Thus, the chamber 12 has a plurality of entry ports for discharging a working gas and a plurality of exhaust ports for venting various gases and by-products of the chamber. The exhaust ports also provide communication between the sub-atmospheric pressure pump and the interior of the chamber, so as to maintain a sub-atmospheric pressure during the cleaning operation. Conventional pressure sensor and regulator means (not shown) is arranged to measure the pressure within the working chamber and to maintain a controlled, sub-atmospheric pressure within the working chamber 12 during operation.

Figure 2:
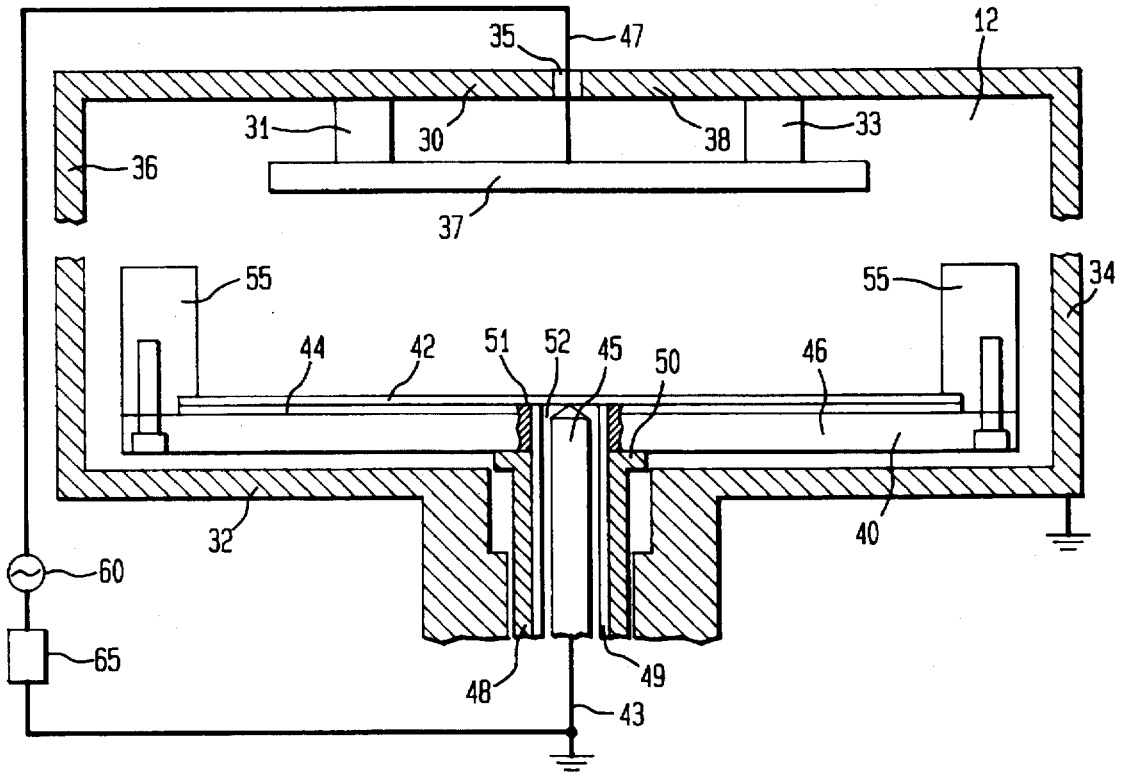
FIG. 2 shows the working chamber of the apparatus illustrated in FIG. 1.

As illustrated in FIG. 2, the working chamber 12 includes a main portion 30 and a base portion 32. The main portion consists of side walls 34 and 36, as well as a top wall 38 interconnecting the side walls. A substantially flat member 37 is spaced between the top wall 38 and the base portion in the vicinity of the former. The member 37 is attached to the top wall 38 by means of electrically insulating intermediary elements 31 and 33. It should be noted, however, that the working chamber having the main portion of any suitable configuration is within the scope of the invention. The base portion 32 is formed to receive support means or a support platform 40 capable of supporting and transporting hollow articles or containers in and out of the working chamber 12. The main portion 30 and the base portion 32 can be made of a conductive material such as steel, aluminum, copper, etc. or dielectric material.

The support means or support platform 40 (best illustrated in FIGS. 1–3) adapted to carry and support the containers to be cleaned, comprises a low loss insulator intermediate plate 44 positioned between a top plate 42 and a bottom plate 46. An opening 51 passing through central portions of the bottom plate 46 and the intermediate plate 44 is provided. The opening 51 is designed to receive a connecting unit 48 including a male terminal 45 of the power supply means. The connecting unit 48 is adapted to facilitate connection between the power source and the support platform 40 serving as an electrode. The connecting unit 48 includes cumulative feed through member 50 having an elongated opening 52. The interior of the opening 52 is covered by an insulating sleeve 49. The connecting unit 48 is adapted for motion along its longitudinal axis within the base portion 32 of the working chamber. In the assembled condition of this embodiment of the invention (see FIG. 2), the conducting feed through member 50 is connected to a central part of the bottom plate 46 a top end of the insulating sleeve 49 engages from opening 51. In this position, the elongated opening 52 extends through the member 50, the bottom plate 46 and the intermediate plate 44 forming a female electrical connector designed to accept a male terminal 45 of the power supply means. In the working position (see FIG. 2), the power supply means 60, through the male terminal 45 is connected directly to the top plate 42 serving as one of the electrodes. Feed through member 50 is connected to ground, thus grounding both in plate 46. Side edges 55 made of an insulating material are provided, and extend substantially upwardly from an outside periphery of the support platform 40.

Steel and aluminum can be used for manufacturing of the top 42 and bottom 46 plates, whereas the intermediate plate 44 is typically made of a low loss insulator, such as Teflon.

Figure 3:
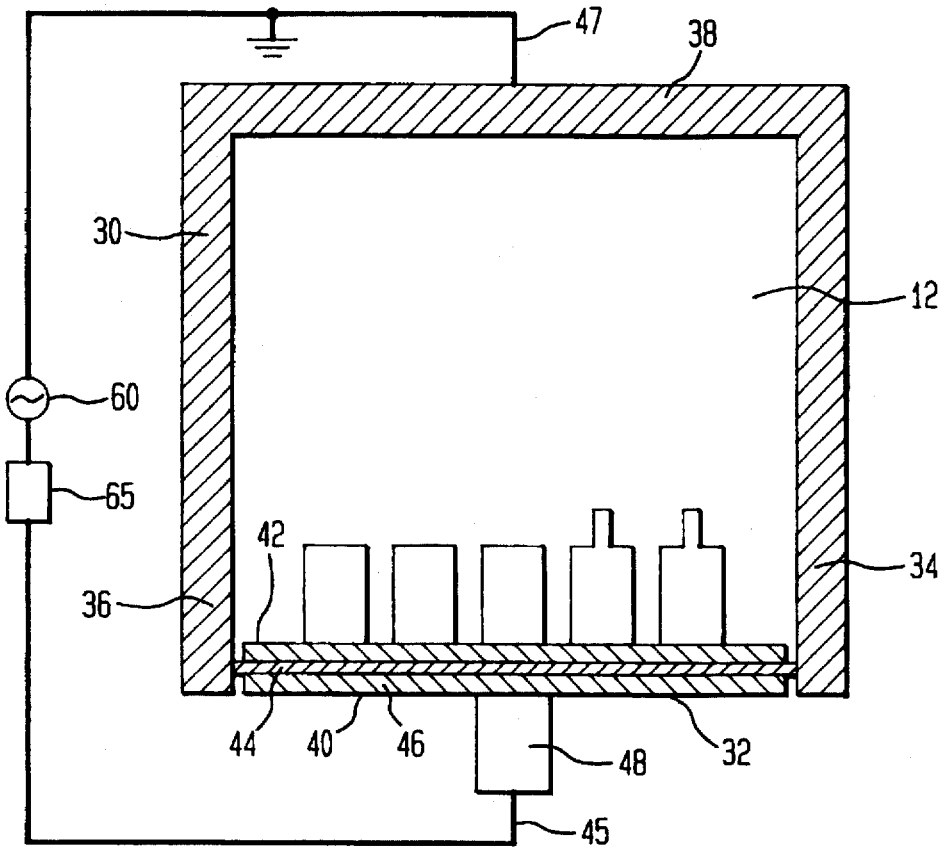
FIG. 3 shows a view of another embodiment of the working chamber.

An assembly or means for applying an electrical potential field is adapted for conversion of the oxidizing, working gas within the working chamber 12 into a low temperature plasma. This assembly consists of a power supply 60 producing an electrical potential and electrode means delivering the electrical potential to the working chamber. In the preferred embodiment of the invention, the electrode means consist of two electrodes capable of creating the necessary electric field within the working chamber. In the embodiment of FIGS. 1–3, the member 37 serves as a first electrode and the second electrode is the top plate 42 of the support platform 40. These two electrodes are connected to power supply means 69, which is preferably a radio-frequency (RF) electrical energy generator capable of producing a high frequency and high voltage potential. In the preferred embodiment, the frequency of RF energy is 13.56 MHz. The power applied typically is about 5 kw or less. The applied voltage is a function of power.

The RF energy generator 60 is typically connected to the first and second electrodes, i.e., to the member 37 and the top plate 42 through terminals 47 and 43, in such a way that when the terminal 47 is connected to the RF source, the terminal 43 is connected to a ground potential. The top wall 38 is formed with an opening 35 enabling the terminal 47 to penetrate into the working chamber in order to be connected to the member 37. Appropriate insulation (not shown) may be provided to insulate the terminal 47 from the top wall 38.

According to another embodiment of the invention, the power supply circuit includes pulsing or switching means 65 connected to the RF electrical energy generator 60 (see FIGS. 2 and 3) and is adapted for switching on and off electrical power within the system. This results in pressure fluctuation within the working chamber 12, so that an additional gas is pumped into the interior of the containers to be cleaned, whereas the products of the oxidation reaction such as water vapor, carbon dioxide etc. are pumped out from the interior of the container.

In the operation of the embodiment of the invention illustrated in FIGS. 1 and 2, the support platform 40 is initially positioned outside the front end 14 of the plasma reactor 10, so that the hollow articles or containers can be placed on top of the top plate 42. Then, the support platform 40 carrying the containers or the hollow articles is moved through the open front gate 15 into the interior of plasma reactor. The front gate 15 is sealed against the front end 14 of the reactor and the rear gate 17 is sealed against the rear end 16. The working or oxidizing gas is then supplied to the working chamber from the source of working gas 24 through the gas manifold 22. The working gas preferably is an oxygen-containing gas which may be selected from a wide group of gases, including, but not limited to, $O_2$, $N_2O$, air etc. or mixture of these gases. By introducing the working gas into the manifold 22, a flow of working gas into the working chamber 12 is achieved. Thus, the working chamber 12 is provided with an appropriate oxidizing gas agent for removal of contaminants from the hollow articles or containers.

An auxiliary gas may be introduced into the working chamber as part of a working gas supply source 24 to facilitate ionization of the working gas. Preferably, such auxiliary gas is a monatomic, readily ionizable gas used to promote plasma initiation in the working gas. If a combination of diatomic oxygen and helium is used for formation of a plasma, the molar ratio of diatomic oxygen and helium in the mixture desirably is between from 1 to 4 to 4 to 1.

The environment within the chamber is purged to eliminate atmospheric gases below operating pressure. Gases passing into the chamber are continuously removed through the ports of exhaust conduit 28 by pump 26. Desirably, the operating pressure within the working chamber 12 should be between 0.1 to 0.5 Torr.

As the working chamber is filled with the working gas or mixture of gases, the RF power source is activated to supply RF power to the first and second electrodes, i.e., to the member 37 and to the top plate 42 of the support platform 40. Then the working gas passing into the working chamber from the entry ports is subjected to the electric field developed by the electrodes. The selected frequency and power level of the electric field substantially ionizes the working gas, so that the working gas is converted into a plasma within the working chamber 12.

Typically, when an ionizable gas is exposed to an electric field, accelerated electrons are freed. Such free electrons gain energy from the imposed electric field and impart this energy through collision with electrically neutral gas molecules to ionize the gas molecules when the electrons collide with the molecules. The collisions produce ions and further electrons which are then accelerated in opposite directions by the electric field. A container positioned in the plasma, generated in this manner, is bombarded by these particles. Particles, for example, may include oxygen ions, thereby enhancing the probability of oxidation of surface contaminants.

When plasma is used for cleaning purposes and specifically for removal of organic greases, oils, etc. from the interior containers used in environmental testing, electrical discharge causes the electrodes to produce the excited gases species. More specifically, diatomic oxygen is transformed into an oxygen plasma containing some oxygen molecules, monatomic oxygen ozone and ions which are capable of reacting with contaminants. It is known, that the gases in their excited states are highly reactive and therefore, substantial energy is present for oxidation of the contaminants.

In particular, the electric field penetrates through the dielectric walls of the containers and converts the working gas within the containers to plasma. Thus, highly reactive ions are present within the containers. Some of the ions and free electrons recombine to form electrically neutral but high-energy active species. The composition of the ions and neutral active species depend on composition of the oxidizing or working gas. If the oxidizing gas includes $O_2$, the neutral activated species might include monatomic oxygen, whereas the ions would include $O^-$. The activated species are substantially more active than the original working gas supplied from the gas source 24. Although the present invention is not limited by any theory of operation, it is believed that both the ions and the neutral active species contribute to the oxidation process. Thus, if an oxygen containing gas is used for forming the plasma, organic contaminants in the container will be oxidized and removed by combined action of oxygen ions, atomic oxygen and molecular oxygen present in the excited gases species. The oxidation reaction typically results in water vapor and carbon dioxide. Nevertheless, traces of other species may also exist upon completion of the process of oxidation.

The duration of the method according to the present invention needed to achieve the required cleanness of the containers typically varies with other parameters, such as working gas flow and pressure, power density and quantity of the containers to be cleaned. However, in the preferred embodiment, the cleaning process is desirably continued for about 1 to about 30 minutes and more preferably between seven and about fifteen minutes. The working chamber 12 and the containers to be cleaned are maintained generally below 40° C. and specifically at a temperature about 20° to 25° C.

Figure 5:
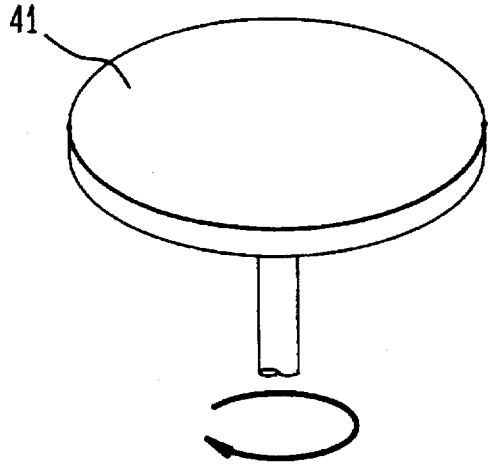
FIG. 5 illustrates another embodiment of the support platform.
Figure 6:
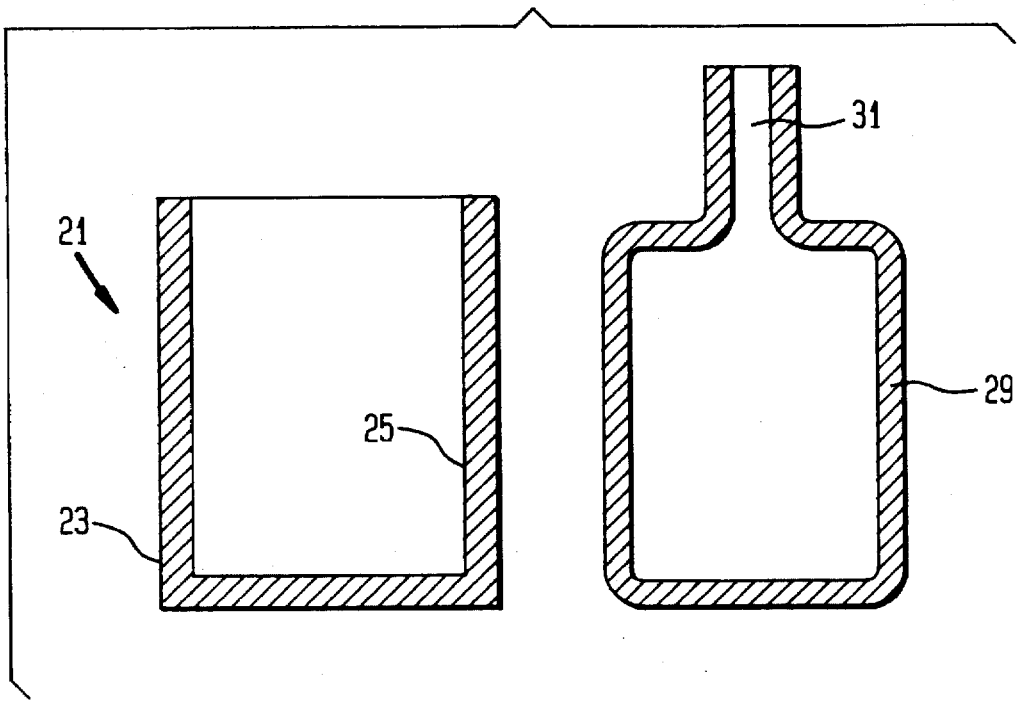
FIG. 6 shows containers adapted for cleaning by the present invention.

Typical hollow articles or containers adapted for cleaning by the present invention (see FIG. 5) consist of a cylindrical hollow body 21 having an exterior portion 23 and an interior, substantially cylindrical portion 25. Another type of a container cleaned by the present invention can be provided with a substantially cylindrical hollow tubular neck 31 having a diameter smaller than a diameter of the cylindrical portion 29. However, containers having any conventional configuration, for example, containers having square, rectangular, triangular, etc. shaped cross-section of their bodies can also be cleaned by the present invention.

In a variation of the embodiment shown in FIG. 2, the first electrode or the member 37 can be connected to a ground potential, whereas the second electrode or the top plate 42 is connected to the power source.

In the alternate embodiment of FIG. 3, the working chamber 12 is formed directly between the main portion 30 and the support platform 40. Initially, during operation of this device, the support platform 40 having the containers to be cleaned, is moved into the interior of the plasma reactor 10. Thus, the working chamber is formed between the main portion 30 and the top plate 42 of the support platform 40, upon the outside periphery of the support platform 40 engaging or being positioned in the vicinity of the lower ends of the walls 34 and 36.

Figure 4:
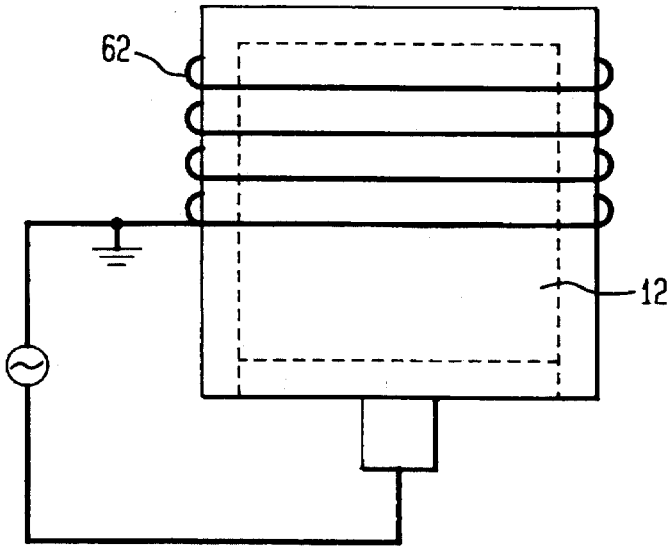
FIG. 4 shows the working chamber having a coil type electrode.

FIG. 4 illustrates the embodiment of the invention in which an electrode associated with the main portion of the working chamber is in the form of a coil 62. The coil electrode typically surrounds at least a part of the exterior of the main portion of the working chamber. The electrodes in the embodiment of FIG. 3 are connected to an RF power source in a manner similar to that described with reference to the preferred embodiment. When the coil electrode surrounding the exterior of the main portion is utilized, the main portion itself can be made of dielectric material such as glass, plastic, etc.

In a further embodiment of the invention, the main portion 30 of the working chamber can serve as a first electrode, whereas the second electrode is again the top plate 42 of the support platform 40. These electrodes are connected to the RF energy generator 60 in such a manner that the main portion 30 is connected to the ground potential and the top plate 42 of the platform is connected to the opposite RF power pole. Thus, when the working chamber is filled with the working gas, the RF power source supplies power to the top plate 42 of the support platform 40 and to the interior of the main portion 30.

Still other embodiments can be used. In a modification to the above-discussed embodiment, the polarity is reversed. The main portion 30 or the first electrode is connected to the power source and the top plate 42 or the second electrode connected to a ground potential. This arrangement is less desirable because such alternative exposes a personnel to dangerous high voltage electricity passing through the main portion of the work chamber.

In another embodiment of the invention, a microwave energy source can be employed instead of the radio-frequency generator.

In FIG. 1 the support platform 40 is formed within a substantially rectangular body. However, in the embodiment illustrated in FIG. 5, the support platform 41 has a substantially circular configuration and can be rotated in the plasma reactor 10 during the cleaning process. This can enhance even distribution of the working gas and plasma throughout the entire load of the container and can improve the quality of the cleaning process.

The plasma reactor illustrated in FIGS. 1 and 2 can be incorporated in mass production cleaning and capping operation, with or without filling. Specifically, the plasma reactor 10 can be positioned at an entry to a clean room 19 where capping of analytical containers is performed. The front gate 15 opens to the outside environment, whereas the rear gate 17 of the reactor opens to the inside of the clean room. Thus, the plasma reactor forms an entry lock for passage of the containers into the clean room. The containers are initially placed on a movable support platform 40 and placed within the plasma reactor through the front gate 15. Once the containers have been cleaned, they are transferred into clean room 19. In the clean room the clean containers can be capped or filled by any suitable means. It is of course possible to utilize one plasma reactor for a number of filling and/or capping lines. In a particularly preferred embodiment of the invention, containers for analytical work can be cleaned as discussed above, whereas closures such as caps and septa for the containers are cleaned separately. The closures desirably may be cleaned using plasma compositions and conditions similar to those discussed above. The closures may be exposed to plasma in a reactor of the type disclosed in copending, commonly owned U.S. patent application No. 08/333,129, the disclosure of which is hereby incorporated by reference herein. The cleaned closures and containers can be reunited in clean room 19.

EXAMPLE 1

40 mL clear borosilicate glass vials are deliberately contaminated with a solution of volatile organic compounds. One group receives a glass vial of a solution containing 500 parts per billion (500 parts in $10^9$ parts) volatile. The other group received 1 cc per vial of 10,000 parts per billion volatile solution. The vials are capped and inverted for up to 20 hours. After contamination, samples from each group are set aside as controls for analysis. The remaining vials are emptied and cleaned individually, using the vial itself as the vacuum chamber. The plasma is generated inside the vial by imposing a radio frequency (13.56 MHz) electromagnetic field using electrodes fitted to the vial's exterior. Caps and septa from inverted vials are separated and placed in a rotating glass chamber, and the plasma is generated in the same manner described for the vials. In both cases the operating pressures are 0.1 to 0.5 Torr, oxygen to helium ratios vary from 1:4 to 4:1, and treatment times range from 1 minutes to 30 minutes under the same plasma conditions. Analyses of plasma treated vials, caps, and liners show that the samples meet EPA specifications for analytical vials.

EXAMPLE 2

Ten certified clean 40 ml clear borosilicate vials (of the type sold under the designation Ichem #S236-0040) were contaminated with a 16 component commercially available chlorinated pesticide mixture (#M608). The contamination level was equal to ten times the CRQL (contract required detection limit) of 0.02 ug/l for DDT as specified in US EPA OSWER directive #9240./0-05A titled "Specifications and Guidance for Contaminant-free Sample Containers".

These ten contaminated vials were processed in approaches generally as shown in FIGS. 1 and 2. The contaminated vials were randomly intermixed with 2080 uncontaminated vials on a 0.91 m wide×1.52 m long metal fixture plate. The fixture was placed in a metal vacuum chamber 0.61 m high×1.22 m wide×1.83 m long. A 0.91 m×1.52 m electrode plate was suspended from the top of the chamber on insulating standoffs 0.37 m above the fixture place containing the vials. The upper electrode was connected to an automatic impedance matching network which was in turn connected to an RF power supply operating at 13.56 MHz. The fixture containing the vials was connected to the grounded side of the matching network creating a parallel plate electrode configuration.

The chamber was evacuated to a base pressure of 0.010 torr at which time 0.4 lpm (liters per minute) of oxygen and 0.02 lpm of argon were introduced into the chamber at a controlled pressure of 0.1 torr. The vials were plasma treated for ten minutes using 2500 watts of RF power. The gas flows were stopped and the chamber was vented to atmospheric pressure.

The plasma cleaned contaminated vials were tested by a NJ DEP certified laboratory using a Varian 3400 gas chromatograph with electron capture detector, RTX1 column, and 3 microliter splitless injection volume. The pesticide levels for all ten contaminated vials were found to be less than the EPA CRQL.

The present invention can be applied to clean a variety of items and not necessarily the containers as described hereinabove. For example, caps used for closing the containers can also be cleaned using the method and apparatus substantially as provided by the invention.

We claim:

1. A method of removing organic compounds from an interior portion of a hollow container having interior and exterior portions and having organic compounds in said interior portion, said method comprising the steps of:

(a) introducing an oxidizing, working gas within an interior portion of said container having organic compounds therein, while maintaining sub-atmosphere pressure therein; and (b) applying an electric field for converting said working gas within at least said interior portion into a low temperature plasma, and maintaining said plasma so that said plasma oxidizes substantially all of the organic compounds situated within said interior portion of the container.

2. The method of cleaning as claimed in claim 1, wherein in said step "b" said electric field is applied to said interior portion of said container from the exterior thereof.

3. The method of cleaning as claimed in claim 1, wherein said working gas includes one or more components selected from the group consisting of $O_2$, Ar and $N_2$.

4. The method of cleaning as claimed in claim 1, wherein said oxidizing, working gas is an oxygen-containing gas.

5. The method of cleaning as claimed in claim 1, wherein said working gas includes $O_2$ and Ar.

6. The method of cleaning as claimed in claim 1, wherein said electric field is a radio-frequency electric field.

7. The method of cleaning as claimed in claim 6, wherein said radio frequency electric field has frequency of 13.56 MHz.

8. The method of cleaning as claimed in claim 1, wherein said electric field is a microwave frequency electric field.

9. The method of cleaning as claimed in claim 1, wherein in said steps "a" and "b" a pressure of said working gas within said interior portion is between 0.1 and 0.5 Torr.

10. The method of cleaning as claimed in claim 1, wherein in at least said step "b" an operating pressure of said low temperature plasma is between 0.1 and 0.5 Torr.

11. The method of cleaning as claimed in claim 1, wherein said step "b" said electric field is applied by a pair of electrodes disposed adjacent to the container.

12. The method of cleaning as claimed in claim 11, wherein in said step "b" said electric field is generated by a power supply connected to said pair of electrodes, said power supply is capable of producing a high frequency discharge across said electrodes, so as to excite said oxidizing, working gas.

13. The method of cleaning as claimed in claim 1, wherein in said step "b" said oxidizing, working gas is introduced within interior portions of a plurality of containers and said electric field pulses causing pressure fluctuation within said interior potions of said plurality of containers facilitating removal products of oxidation from said interior portions.

14. The method of cleaning as claimed in claim 13, wherein said plurality of containers are made of a dielectric material and said pair of electrodes is applied from said exterior portions of said containers.

15. The method of cleaning as claimed in claim 14, wherein said containers are formed of a material selected from the group consisting of glass, plastic and ceramic.

16. The method of cleaning as claimed in claim 1, wherein the temperature of said low temperature plasma is below 40° C.

17. The method of cleaning as claimed in claim 1 further comprising the steps of cleaning a closure for the container by exposing the closure to a plasma and uniting the closure with the container after said step of cleaning the closure and after said steps (a) and (b).

18. A method as claimed in claim 17 wherein said step of uniting the closure with the container is performed while said container is empty, to thereby provide a closed empty container for collection of an analytical sample.

19. A method as claimed in claim 18 wherein said organic compounds in said interior portion of said container are selected from the group consisting of volatiles, semivolatiles, greases, oils, and pesticides.

20. A method as claimed in claim 18 wherein said container, after said steps (a) and (b) and after said step of uniting the closure with the container, meets the specifications of US EPA OSWER directive #9240.0-05A.

21. A method of removing organic compounds from an interior portion of a hollow container having interior and exterior portions and having organic contaminants in said interior portion, said method comprising the steps of:

(a) introducing an oxidizing, working gas within said interior portion of said container having organic compounds therein while maintaining sub-atmospheric pressure therein; and (b) applying an electric field for converting said working gas within at least said interior portion into a low temperature plasma, and maintaining said plasma so that said plasma oxidizes substantially all of the organic compounds situated within said interior portion of the container the method further comprising the steps of cleaning a closure for the container by exposing the closure to a plasma and uniting the closure with the container after said step of cleaning the closure and after said steps (a) and (b)

wherein said step of uniting the closure with the container is performed within an enclosed clean room, said steps (a) and (b) being performed within a plasma treatment chamber, the method further comprising the steps of introducing the container from outside of said clean room into the plasma treatment chamber and transferring the container directly from the treatment chamber into the clean room after performing said steps (a) and (b).

22. A method as claimed in claim 21 wherein said step of uniting the closure with the container is performed while said container is empty, to thereby provide a closed empty container for collection of an analytical sample.

23. A method as claimed in claim 22 wherein said organic compounds in said interior portion of said container are selected from the group consisting of volatiles, semivolatiles, greases, oils, and pesticides.

24. A method as claimed in claim 22 wherein said container, after said steps (a) and (b) and after said step of uniting the closure with the container, meets the specifications of US EPA OSWER directive #9240.0-05A.

* * * * *

UNITED STATES PATENT AND TRADEMARK OFFICE

CERTIFICATE OF CORRECTION

PATENT NO. : 5,700,327

DATED : December 23, 1997

INVENTOR(S) : Babacz et al.

It is certified that error appears in the above-identified patent and that said Letters Patent is hereby corrected as shown below:

Column 1, line 18, "require" should read --requires--.

Column 1, line 35, "involving" should read --involve--.

Column 1, line 42, "disposed following" should read --disposed of following--.

Column 1, line 44, "increase" should read --increases--.

Column 1, line 46, "restrict" should read --restricts--.

Column 1, line 56, "for improved" should read --for an improved--.

Column 3, line 50, "is arranged" should read --are arranged--.

Signed and Sealed this

Twenty-first Day of April, 1998

Bruce Lehman

*Attest:*

BRUCE LEHMAN

*Attesting Officer*

*Commissioner of Patents and Trademarks*

UNITED STATES PATENT AND TRADEMARK OFFICE
CERTIFICATE OF CORRECTION

PATENT NO. : 5,700,327

DATED : December 23, 1997

INVENTOR(S) : Babacz et al.

It is certified that error appears in the above-identified patent and that said Letters Patent is hereby corrected as shown below:

Column 4, line 21, "46 a" should read --46 while a--.

Column 4, line 27, "45 is" should read --45, is--.

Column 6, line 5, "known, that" should read --known that--.

Column 9, line 1, "sub-atmosphere" should read --sub-atmospheric--.

Column 9, line 33, "said" (1st. occurrence) should read--in said--.

Column 9, line 45, "potions" should read --portions--.

Column 10, line 23, "therein;" should read--therein,--.

Signed and Sealed this

Twenty-first Day of April, 1998

Bruce Lehman

*Attest:*

BRUCE LEHMAN

*Attesting Officer*

*Commissioner of Patents and Trademarks*